US008287258B2

(12) United States Patent
Fermini et al.

(10) Patent No.: US 8,287,258 B2
(45) Date of Patent: Oct. 16, 2012

(54) POSITIVE DISPLACEMENT PUMP WITH IMPELLER AND METHOD OF MANUFACTURING

(75) Inventors: Franco Fermini, Offanengo (IT); Vittorio Polloni, Offanengo (IT)

(73) Assignee: VHIT S.p.A., Offanengo (IT)

( * ) Notice: Subject to any disclaimer, the term of this patent is extended or adjusted under 35 U.S.C. 154(b) by 0 days.

(21) Appl. No.: 13/141,621

(22) PCT Filed: Dec. 22, 2009

(86) PCT No.: PCT/IB2009/055902

§ 371 (c)(1), (2), (4) Date: Jun. 22, 2011

(87) PCT Pub. No.: WO2010/073215

PCT Pub. Date: Jul. 1, 2010

(65) Prior Publication Data

US 2011/0256012 A1 Oct. 20, 2011

(30) Foreign Application Priority Data

Dec. 23, 2008 (IT) ..... TO2008A0976

(51) Int. Cl.

| | |
|---|---|
| ***F03C 2/00*** | (2006.01) |
| ***F03C 4/00*** | (2006.01) |
| ***F04C 2/00*** | (2006.01) |

(52) U.S. Cl. ..... 418/193; 418/153

(58) Field of Classification Search ..... 418/152, 418/153, 193, 195, 196

See application file for complete search history.

(56) References Cited

U.S. PATENT DOCUMENTS

| | | | | |
|---|---|---|---|---|
| 1,347,512 | A * | 7/1920 | Kirby | 418/153 |
| 2,101,051 | A * | 12/1937 | Cuny | 418/193 |
| 2,101,428 | A | 12/1937 | Cuny | |
| 2,814,255 | A * | 11/1957 | Lorenzetti | 418/153 |
| 3,847,515 | A | 11/1974 | Caldwell | |
| 4,648,813 | A * | 3/1987 | Mikulan | 418/193 |

FOREIGN PATENT DOCUMENTS

| | | | |
|---|---|---|---|
| DE | 1 943 726 | A1 | 3/1971 |
| DE | 25 29 720 | A1 | 1/1977 |
| JP | 09250495 | A * | 9/1997 |

* cited by examiner

*Primary Examiner* — Theresa Trieu
(74) *Attorney, Agent, or Firm* — Sughrue Mion, PLLC

(57) ABSTRACT

A rotary positive displacement pump (1) that includes an impeller (3) that defines, within a pumping chamber (20), a plurality of successive chambers (21) with variable volume through which a fluid is mechanically conveyed from an inlet (7) to an outlet (8). The chambers (21) with variable volume are defined, at axially opposite ends, by a pair of rotational surfaces (40, 50) that close the pumping chamber (20) and are arranged to rotate about mutually inclined axes. Also described is a method of manufacturing the pump.

10 Claims, 3 Drawing Sheets

POSITIVE DISPLACEMENT PUMP WITH IMPELLER AND METHOD OF MANUFACTURING

FIELD OF THE INVENTION

The present invention relates to a rotary positive displacement pump with impeller, where the impeller defines, within a pumping chamber, chambers with variable volume through which a fluid is mechanically conveyed from an inlet to an outlet of the pump.

BACKROUND

Such pumps are known from a long time and are used in several technical fields.

The prior art pumps with impeller, which use eccentric rotating members, are often unsatisfactory in respect of one or more of the following aspects:

- high cost, also related to the high number of pump components, to a limited standardisation thereof, to the materials employed and to the workings required to manufacture such components;
- limited performance for a given swept volume;
- limited geometrical tolerances;
- low flexibility of use;
- need of lubrication, making their use unsuitable in certain applications.

Certain objects of invention

It is an object of the invention to provide a positive displacement pump with impeller, and a method of manufacturing the same, which do not suffer from the drawbacks of the prior art.

According to the invention, this object is achieved in that said chambers with variable volume are defined, at axially opposite ends, by a pair of rotational surfaces that axially close said pumping chamber and are arranged to rotate about mutually inclined axes.

Preferably, said surfaces are conical surfaces or surfaces shaped as spherical caps, and are the facing surfaces of a pair of discs or spherical caps, the axes of which coincide with the axes of said surfaces and which are made to rotate by the impeller.

Preferably, the impeller has a plurality of radial blades engaging with a certain clearance radial slots of the surfaces.

The invention also relates to a method of manufacturing the pump described above, including the steps of:

- providing a pumping chamber;
- mounting an impeller in said pumping chamber;
- closing the pumping chamber, at axially opposite ends, by means of a pair of rotational surfaces having mutually inclined axes and arranged to engage the impeller in order to be made to rotate.

BRIEF DESCRIPTION OF THE FIGURES

The invention will now be described in greater detail with reference to the accompanying drawings, which show a preferred embodiment given by way of non limiting example and in which.

DETAILED DESCRIPTION OF CERTAIN EMBODIMENTS

Figure 1:
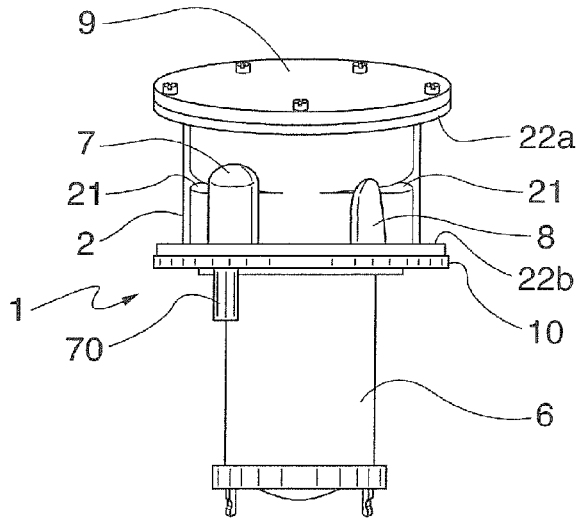
FIG. 1 is an elevation view of the pump according to the invention.

Referring to FIGS. 1 to 5, the pump according to the invention, generally denoted by reference numeral 1, includes a tubular pump body or stator 2, defining a pumping chamber 20 that is closed at its top and bottom ends by covers 9, 10 secured on end flanges 22*a* and 22*b*, respectively, of stator 2. An intake port (inlet) 7 and an exhaust port (outlet) 8 for the fluid being pumped open in chamber 20. Chamber 20 houses the rotor, consisting of a blade impeller 3 and of two discs 4, 5 made to rotate by impeller 3. Said discs are mounted on axially opposite sides of impeller 3 and have mutually inclined axes. Taking into account the drawing, hereinafter discs 4, 5 will also be referred to as upper disc and lower disc, respectively.

If necessary, rotary seals may be provided between discs 4, 5 and the walls of chamber 20, in order to avoid leakages.

In order to house the inclined discs, stator 2 and chamber 20 are elbow shaped.

Figure 4:
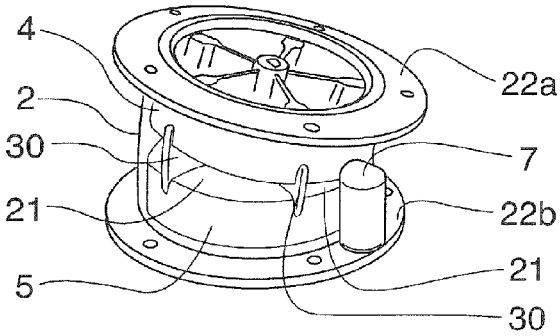
FIG. 4 is an elevation view of the stator and the rotor.
Figure 3:
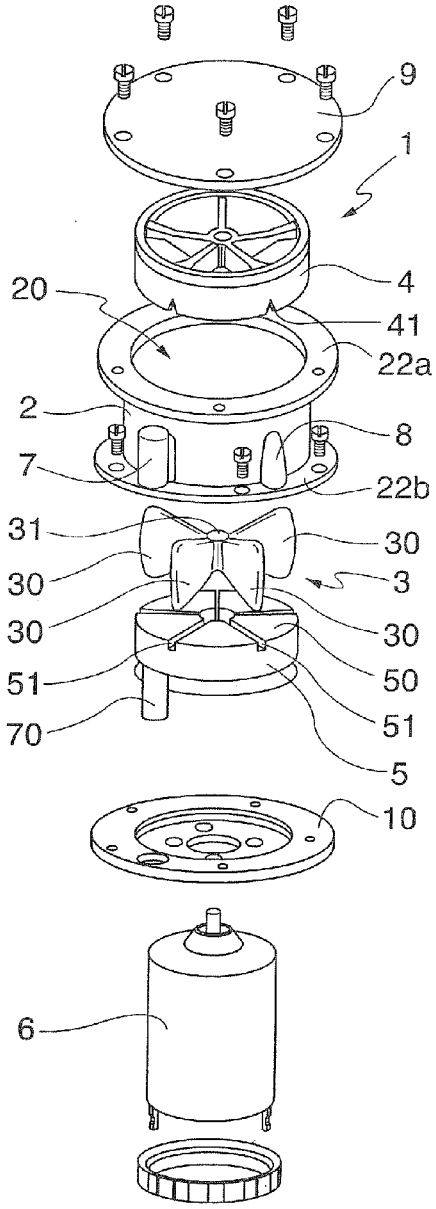
FIG. 3 is an exploded view.

Facing surfaces 40, 50 of upper disc 4 and lower disc 5 are rotational surfaces the axial sections of which have a height progressively increasing from the edge towards the axis of the disc. In the exemplary embodiment described herein, surfaces 40, 50 are conical surfaces, with axes coinciding with the axes of the discs, and the discs are preferably mounted in chamber 20 so that a generatrix of conical surface 40 of upper disc 4 is substantially parallel with a generatrix of conical surface 50 of lower disc 5, as shown in FIG. 4. In other embodiments, surfaces 40, 50, instead of being conical, may be shaped as spherical caps. Anyway, advantageously discs 4, 5 are identical to each other, so as to make the structure and the manufacture of the pump simpler and to keep limited the number of different pieces to be made.

The spacing between discs 4, 5 may be adjustable, and to this end at least upper disc 4 is mounted in chamber 20 so that its axial position can be varied. Preferably, both discs are substantially adjacent to each other in correspondence of the respective parallel generatrices. The variation of the disc spacing is obtained for instance by means of pneumatic actuators, not shown. In case of reverse rotation of the pump, the disc displacement may also occur starting from a given pressure.

Figure 5:
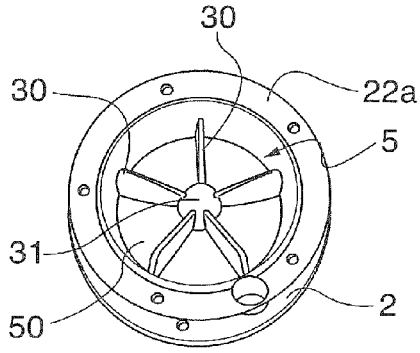
FIG. 5 is a view showing the impeller and one of the discs in mutual engagement.

Impeller 3 is a butterfly impeller, with substantially trapezoidal blades 30 joined by their small bases to a central hub 31, integral with a shaft (not shown) in turn connected to a suitable driving device. Impeller 3 rotates about its axis, is pivoted at the centre of both discs 4, 5, as shown in FIG. 5 for disc 5, and the upper and lower edges of its blades 30 engage radial slots 41 and 51 (FIG. 3), respectively, in surfaces 40, 50 of discs 4, 5 in order to make the discs rotate.

Figure 2:
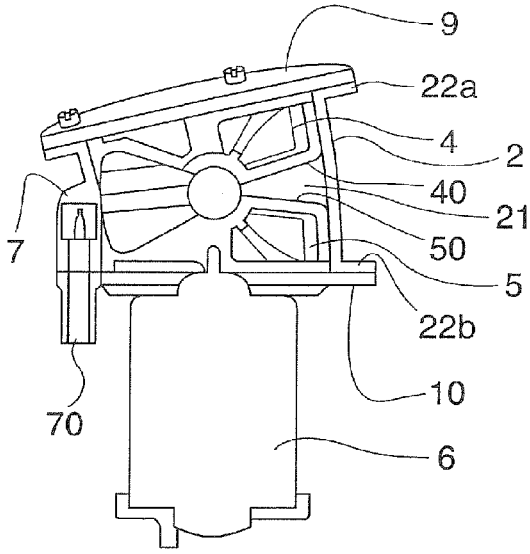
FIG. 2 is an axial sectional view.

Blades 30 of impeller 3 engage radial slots 41 and 51 with an axial clearance, as shown in FIG. 2. Taking into account the inclination of the axes of conical surfaces 40, 50 and assuming that the upper and lower edges of blades 30 have the same inclination, each blade will have a different clearance with the respective slot of upper disc 4 and lower disc 5, and different blades will have different clearances with the respective slots in both discs (or at least with the slots in upper disc 4, assuming that lower disc 5 has a vertical axis, as shown in the drawings). By such an arrangement, blades 30 and surfaces

40, 50 define, inside elbowed chamber 20, a plurality of successive chambers 21 with progressively variable volume (FIGS. 1, 2 and 4).

The swept volume of pump 1 depends on the angle between conical surfaces 40, 50 at their centres (hence on their aperture and the inclination of their axes of rotation), on the axial and radial sizes of discs 4, 5, as well as on the number and the thickness of blades 30. The relative inclination of the axes of conical surfaces 40, 50 also affects the rotation speed of pump 1. Actually, the smaller such an inclination, the smaller the stresses on the pump and hence the higher the rotation speed may be. Theoretically, the inclination of the axes may range from a value immediately higher than 0° to a value immediately lower than 90°. In practice, a suitable inclination for the preferred applications of the invention (e.g. vacuum pumps) will be lower than 10°, for instance of the order of 5°-6°. Clearly, if the conical surfaces are arranged so that respective generatrices are parallel, the angle defined by said surfaces in a position offset by 180° relative to the parallel generatrices will be twice the angle of inclination of the axes.

In the illustrated embodiment, impeller 3 is made to rotate by an external electric motor 6. In other embodiments, the drive may be a magnetic drive. The latter solution is particularly suitable for applications in which it is desired to keep the pumping module (chamber 20 and rotor 3, 4, 5) isolated from the outside. As a further alternative, an electric motor integrated into one of the discs could be employed.

Turning back to the intake and exhaust ports (inlet and outlet) 7 and 8, inlet 7 is connected to an intake duct 70 and is possibly associated with a nonreturn valve. Outlet 8 too may be associated with a valve. The provision of valves at the intake and the exhaust assist in improving the performance of pump 1. Yet, the greater the subdivision of the swept volume of the pump determined by the number of blades 30, the smaller the need to provide valves in order to ensure the proper operation.

The location of intake and exhaust ports 7 and 8 is not binding for the installation of pump 1. Advantageously however the exhaust is directed towards the rear side of one or both discs 4, 5. In this manner, the fluid exhausted assists in pushing the discs in central direction, thereby reducing the clearances during rotation. In case of application to a vacuum pump using external electric motor 6 to drive impeller 3, by directing the exhaust rearwards of the disc located on the drive side (lower disc 5 in the drawings), the exhausted fluid can be used to cool the electric motor, thereby increasing its efficiency. An exhaust directed inside the pump also assists in reducing noise. However, the exhaust could be even directed outside the pump.

Advantageously, the components of pump 1 can be manufactured by moulding plastic materials, for instance with the addition of elastomers in order to impart a certain flexibility to the materials. This allows mounting the components with a slight interference, without the components being damaged or without the components damaging other stationary or moving parts. Moreover, stator 2 may be made of transparent plastics. The specific material will depend on the nature of the fluid being pumped.

Figure 6:
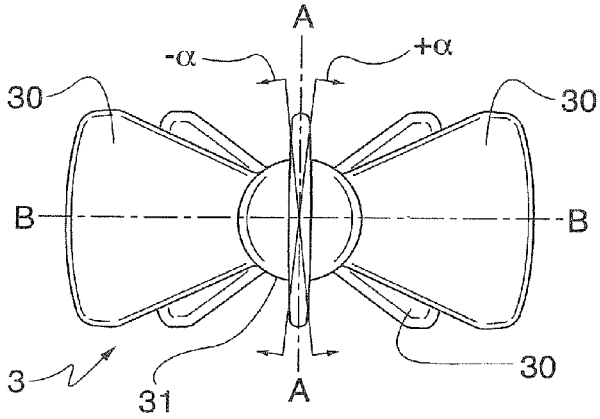
FIG. 6 is a front view of the impeller.

Use of such materials allows optimising the pump geometry and achieving a reduced weight, what makes attainment of high rotation speeds easier. In particular, blades 30 must be capable of bending in radial direction (referring to FIG. 6, about the axis denoted by dotted line A-A), in order to match the variations in the height of chambers 21. Bending angle $\alpha$ depends of course on the angle between the facing surfaces and preferably is of a few degrees (e.g. 4° to 6°). The blade flexibility can also be obtained by making them of rubber or of a metal coated with a flexible material. Depending on the flexibility of the material and the clearance between blades 30 and slots 41, 51, the angle between the axes of discs 4, 5, and hence the swept volume of the pump, can be increased.

It is to be appreciated that, in case the pump is used as a compressor or a vacuum pump, lubrication between the components moving relative to each other is not required. For instance, roller or ball bearings could be provided or materials with high slip coefficient, well known in the art, could be used.

As stated above, the rotational surfaces with mutually inclined axes result in a plurality of successive chambers 21 with variable volume being defined in chamber 20, whereby the operation includes expansion and compression steps of a fluid volume conveyed, with consequent intake and exhaust of the same. The maximum delivery pressure will be determined based on the geometry of disc surfaces 40, 50 and their axial sealing system. Such a delivery pressure may be adjusted by acting on the disc spacing.

The following operations are envisaged in order to manufacture the pump described above:

- providing elbowed pumping chamber 20;
- mounting impeller 3 in pumping chamber 20 so that the impeller rotates about its axis;
- closing pumping chamber 20, at axially opposite ends, by means of a pair of rotational surfaces 40, 50, arranged to rotate about mutually inclined axes and arranged in rotational engagement with impeller 3.

It is evident that the invention attains the desired objects. The number of components is lower than in prior art solutions and the components themselves are made of relatively cheap materials and allow wide tolerances, so that expensive precision workings are not required. Use of plastic materials makes optimisation of the geometry easier and, jointly with the reduced weight of the components and the absence of eccentrically rotating parts, allows using the pump at high speed, while further enabling the attainment of high performance. Moreover, some components, in particular discs 4, 5, are identical and also this feature assists in reducing the manufacturing costs. The shape of the rotor components further allows a wide flexibility in the design, in order to adapt pump 1 to different applications with different requirements. The peculiar geometry allows easily assembling the components. Lastly, the arrangement of the components results in a reduced axial size.

Figure 7:
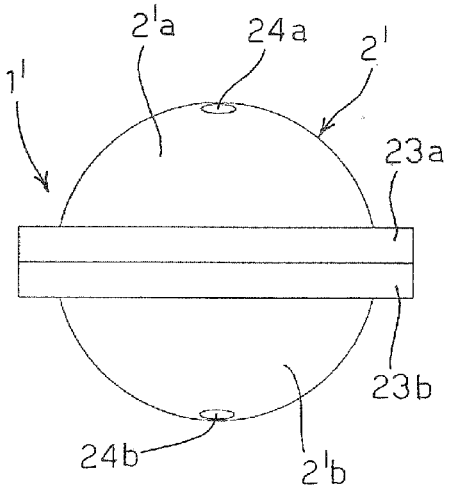
FIG. 7 is an elevation view of a variant embodiment.
Figure 8:
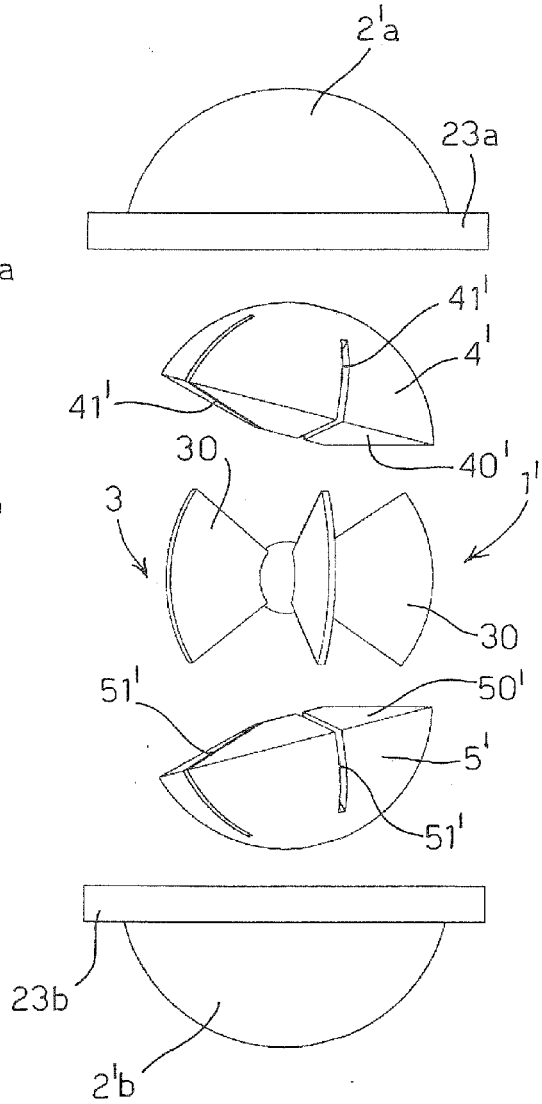
FIG. 8 is an exploded view of the pump shown in FIG. 7.

In the variant embodiment shown in FIGS. 7 and 8, where elements corresponding to those shown in the previous Figures are denoted by the same reference numerals with the addition of a prime, pump 1' includes a pump body or stator 2' made up of two hemispherical bodies 2'*a*, 2*b* joined in correspondence of flanges 23*a*, 23*b* provided along the circumference of the respective bases. Stator 2' defines a substantially spherical pumping chamber 20 housing the rotor, made up of blade impeller 3' and a pair of spherical caps 4', 5' located on opposite sides of the impeller. Like discs 4, 5 in the embodiment shown in FIGS. 1 to 6, caps 4', 5' are rotatable about mutually inclined axes and their facing surfaces 40', 50' are rotational surfaces (in the shape of cones or spherical caps), the axial section of which has a height progressively increasing from the edge towards the axis of the cap. Moreover, such surfaces 40', 50' have radial slots 41 and 51, respectively, which are engaged by the edges of blades 30' of impeller 3'.

Both hemispherical bodies 2'*a*, 2'*b* further have holes 24*a*, 24*b* coaxial with the axes of rotation of caps 4', 5'. One of such holes serves for the passage of members linking impeller 3' to a rotation generator (e.g. an electric motor like motor 6 shown in FIGS. 1 to 3). The other hole is not used and it will be closed in any suitable manner. Its provision is only due to reasons of cheapness of manufacturing, in that it allows manufacturing both hemispherical bodies 2'*a*, 2'*b* with the same mould.

The operation of such a variant embodiment is the same as that of the embodiment shown in FIGS. 1 to 6.

With respect to the embodiment shown in FIGS. 1 to 6, such a variant embodiment allows reducing the axial size of the pump, improving the alignment and the guidance of the pieces and obtaining reduced clearances, so that the need to have highly flexible blades is reduced.

It is clear that the above description has been given only by way of non-limiting example and that further changes and modifications are possible without departing from the scope of the invention as defined by the following claims.

The invention claimed is:

1. A rotary positive displacement pump with impeller, where the impeller or rotor defines, within a stator defining a pumping chamber, a plurality of successive chambers with variable volume through which a fluid is mechanically conveyed from an inlet to an outlet of the pump, said chambers with variable volume being defined, at axially opposite ends, by a pair of rotational surfaces that axially close said pumping chamber and are arranged to rotate about mutually inclined axes;

the stator and the rotor are made of flexible material; and the impeller has a plurality of radial blades and said rotational surfaces have radial slots that are engaged by the blades of the impeller.

2. The pump as claimed in claim 1, wherein said rotational surfaces are conical surfaces or surfaces shaped as spherical caps.

3. The pump as claimed in claim 2, wherein said rotational surfaces are facing surfaces of a pair of discs or spherical caps, which have axes coinciding with the axes of said surfaces and are made to rotate about their axes by the impeller.

4. The pump as claimed in claim 3, wherein said facing surfaces have an axial section whose height progressively increases from the edge towards the axis.

5. The pump as claimed in claim 2, wherein said surfaces are mounted with an adjustable axial distance.

6. The pump as claimed in claim 1, wherein said rotational surfaces are facing surfaces of a pair of discs or spherical caps, which have axes coinciding with the axes of said surfaces and are made to rotate about their axes by the impeller.

7. The pump as claimed in claim 6, wherein said facing surfaces have an axial section whose height progressively increases from the edge towards the axis.

8. The pump as claimed in claim 1, wherein the blades engage said slots with axial clearance.

9. The pump as claimed in claim 1, wherein said surfaces are conical surfaces and are arranged so that a generatrix of one surface is parallel with a generatrix of the other surface and so that such surfaces are adjacent to each other in correspondence of said parallel generatrices.

10. A method of manufacturing the positive displacement pump with impeller of claim 1, comprising the steps of:

providing the stator defining the pumping chamber made of flexible material;

mounting an impeller or rotor made of flexible material in said pumping chamber, said impeller having a plurality of radial blades;

closing the pumping chamber, at axially opposite ends, by the pair of rotational surfaces having mutually inclined axes and arranged in rotational engagement with the impeller through the radial slots that are engaged by the radial blades of the impeller.

* * * * *